US008872707B2

(12) United States Patent
Chen et al.

(10) Patent No.: US 8,872,707 B2
(45) Date of Patent: Oct. 28, 2014

(54) MULTI-BAND ANTENNA FOR TABLET COMPUTER

(75) Inventors: Wen-Shan Chen, Tainan (TW); Wei-Chiang Jhang, Tainan (TW)

(73) Assignee: Southern Taiwan University of Technology, Tainan (TW)

( * ) Notice: Subject to any disclaimer, the term of this patent is extended or adjusted under 35 U.S.C. 154(b) by 179 days.

(21) Appl. No.: 13/537,290

(22) Filed: Jun. 29, 2012

(65) Prior Publication Data

US 2014/0002308 A1 Jan. 2, 2014

(51) Int. Cl.
*H01Q 5/01* (2006.01)

(52) U.S. Cl.
USPC ..... 343/702; 343/700 MS; 343/828; 343/829

(58) Field of Classification Search
USPC ..... 343/700 MS, 702, 828, 829
See application file for complete search history.

(56) References Cited

U.S. PATENT DOCUMENTS

| | | | | |
|---|---|---|---|---|
| 6,239,765 | B1 * | 5/2001 | Johnson et al. | 343/795 |
| 7,705,784 | B2 * | 4/2010 | Lai et al. | 343/700 MS |
| 2005/0190108 | A1 * | 9/2005 | Lin et al. | 343/702 |
| 2009/0295653 | A1 * | 12/2009 | Komura | 343/702 |
| 2012/0146875 | A1 * | 6/2012 | Ali et al. | 343/848 |

FOREIGN PATENT DOCUMENTS

| | | | |
|---|---|---|---|
| TW | 201021292 | A | 6/2010 |
| TW | 201123617 | A | 7/2011 |

* cited by examiner

*Primary Examiner* — Dameon E Levi
*Assistant Examiner* — Harold L Rappaport
(74) *Attorney, Agent, or Firm* — Rosenberg, Klein & Lee

(57) ABSTRACT

A multi-band antenna for tablet computers is revealed. The antenna includes a first path, a second path, a third path, a fourth path, a fifth path, a sixth path, a seventh path, an eighth path and a grounding portion, connected to one another. Thereby the antenna can cover the GSM 850/900/1800/1900/UMTS and LTE 700/2300/2700 operations.

1 Claim, 26 Drawing Sheets

MULTI-BAND ANTENNA FOR TABLET COMPUTER

BACKGROUND OF THE INVENTION

1. Field of the Invention

The present invention relates to a multi-band antenna for tablet computers, especially to a multi-band antenna for tablet computers that covers the GSM850/900/1800/1900/UMTS and LTE700/2300/2700 operations. The multi-band antenna has higher practical value and more applications.

2. Description of Related Art

Along with fast progress in information and communication technologies, people have more requirements for wireless communication technology, not only the quality but also the speed. There are various systems for electronics with communication receivers. The antenna systems of the electronics are not compatible due to different system operation frequencies.

Refer to Taiwanese Pat. App. Pub. No. 201123617 published on Jul. 1, 2011, a multi-band antenna is revealed. The multi-band antenna includes an antenna body, a flat substrate, a grounding part and a feed point. The multi-band antenna is a three-dimensional structure having a bottom surface, a rear surface, a top surface and an outer surface. The above four surfaces are respectively disposed with the antenna body. The flat substrate and the grounding part are arranged at the bottom surface of the multi-band antenna. The flat substrate is located on a gap between the grounding part and the antenna body on the bottom surface of the multi-band antenna. The antenna body, the flat substrate and the grounding part are connected at the feed point.

Refer to Taiwanese Pat. App. Pub. No. 201021292 published on Jun. 1, 2010, a multi-band antenna is revealed. The multi-band antenna includes a loop microstrip line and a parasitic microstrip line. The loop microstrip line consists of a signal feed end and a first grounding end. The length of a path between the signal feed end and the first grounding end is a half wavelength. A signal is input through the signal feed end to excite a first resonant mode frequency from the loop microstrip line. The parasitic microstrip line is composed of a second grounding end and a first open end. The length of a path between the first open end and the second grounding end is one-fourth wavelength. The loop microstrip line is arranged around the parasitic microstrip line. Electromagnetic radiation with the first resonant mode frequency is coupled to the parasitic microstrip line so that the parasitic microstrip line is excited to have a second resonant mode frequency. The second resonant mode frequency is different from the first resonant mode frequency.

However, although the antennas mentioned above perform the expected functions while being applied to multiple system band frequencies, they still have certain limitations. In practice, LTE (Long Term Evolution), a next-generation wireless broadband technology, has been developed. Compared with GSM, the LTE provides higher data speed and a lot better quality. LTE standard can be used with many different frequency bands including 700, 2300, 2500 MHz. Yet GSM-850/900/1800/1900 MHz and UTMS bands are still in use. The above antennas are unable to be used for a broad range of frequencies including LTE700/2300/2500, GSM 850/900/1800/1900, UMTS, etc and there is room for improvement.

SUMMARY OF THE INVENTION

Therefore it is a primary object of the present invention to provide a multi-band antenna for tablet computers that covers the GSM850/900/1800/1900/UMTS and LTE700/2300/2700 operations.

In order to achieve the above object, a multi-band antenna for tablet computers of the present invention includes a first path, a second path, a third path, a fourth path, a fifth path, a sixth path, a seventh path, an eighth path and a grounding portion. The first path includes a bent part arranged at a first end thereof. Two ends of the second path are respectively extended to form a bent part and an extension part while the bent part is connected to a second end of the first path. The third path consists of a first bent part at a first end thereof and a second bent part at a second end thereof. A middle part of the third path is connected to the extension part of the second path. The first end of the fourth path is connected to the second path. The fifth path is connected to a second end of the fourth path. Two ends of the fifth path are respectively extended to form a first extension part and a second extension part corresponding and parallel to each other. Two ends of the sixth path are respectively a first bent part and a second bent part. The first bent part of the sixth path is connected to the first extension part of the fifth path. The seventh path is connected to the second bent part of the sixth path. Two ends of the eighth path are formed a first bent part and a second bent part respectively. The first bent part of the eighth path is connected to the second extension part of the fifth path. The grounding portion is connected to the second bent part of the third path and the second bent part of the eighth path. Thereby the multi-band antenna is used for multi-band operations including the GSM850/900/1800/1900/UMTS and LTE700/2300/2700, etc.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
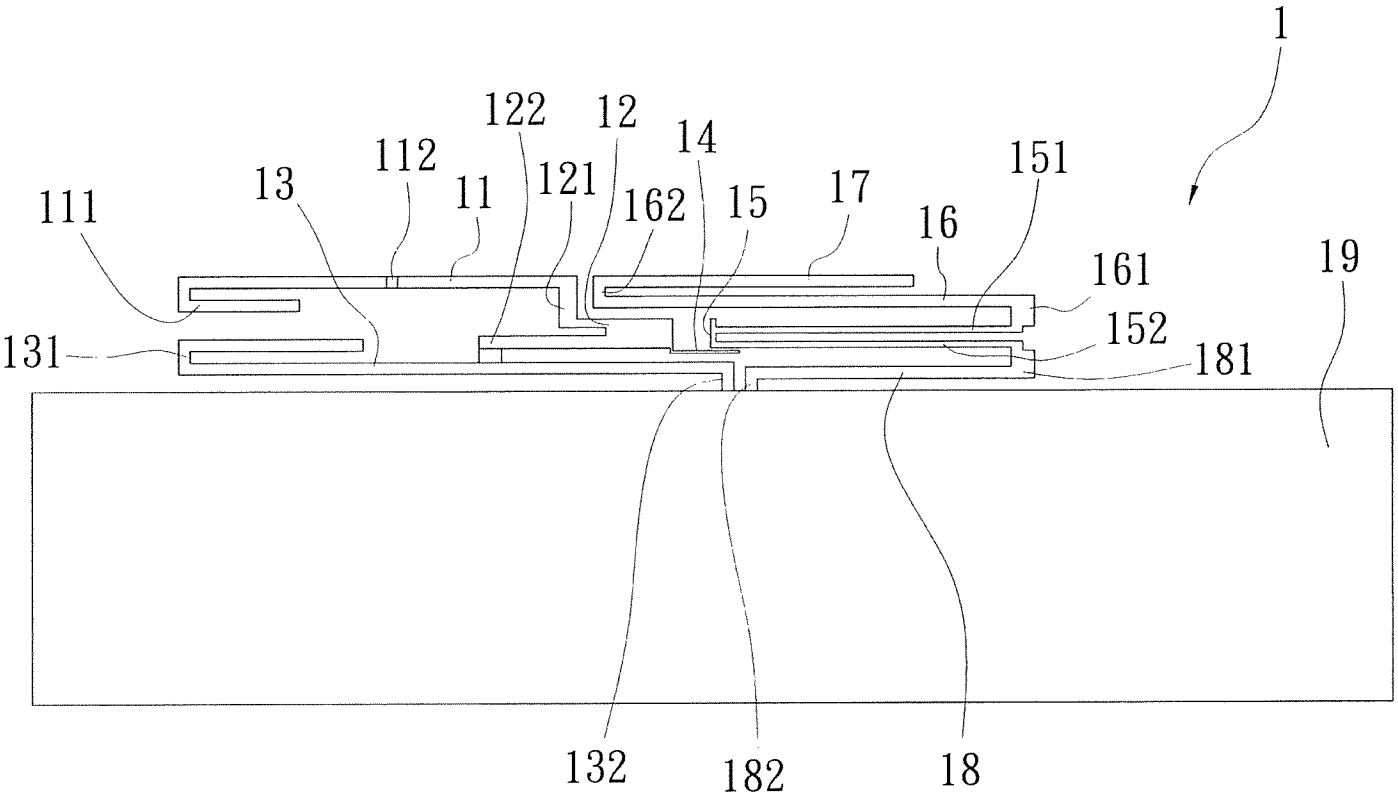
FIG. 1 is a schematic drawing showing a structure of an embodiment according to the present invention.

Refer to FIG. 1, an antenna 1 of the present invention includes a first path 11, a second path 12, a third path 13, a fourth path 14, a fifth path 15, a sixth path 16, a seventh path 17, an eighth path 18 and a grounding portion 19. The first path 11 includes a bent part 111 arranged at a first end thereof. A chip inductor 112 is disposed on the first path 11.

Two ends of the second path 12 are extended to form a bent part 121 and an extension part 122 respectively while the bent part 121 is connected to a second end of the first path 11.

A first end of the third path 13 is a first bent part 131 while a second end of the third path 13 is a second bent part 132. A middle part of the third path 13 is connected to the extension part 122 of the second path 12.

As to the fourth path 14, its first end is connected to the second path 12.

The fifth path 15 is connected to a second end of the fourth path 14. Two ends of the fifth path 15 are extended to form a first extension part 151 and a second extension part 152 respectively. The first extension part 151 and the second extension part 152 are corresponding and parallel to each other.

Two ends of the sixth path 16 are respectively a first bent part 161 and a second bent part 162 while the first bent part 161 is connected to the first extension part 151 of the fifth path 15.

The seventh path 17 is connected to the second bent part 162 of the sixth path 16.

The eighth path 18 includes a first bent part 181 and a second bent part 182 respectively formed on two ends thereof The first bent part 181 is connected to the second extension part 152 of the fifth path 15.

The grounding portion 19 is connected to the second bent part 132 of the third path 13 and the second bent part 182 of the eighth path 18.

Figure 2:
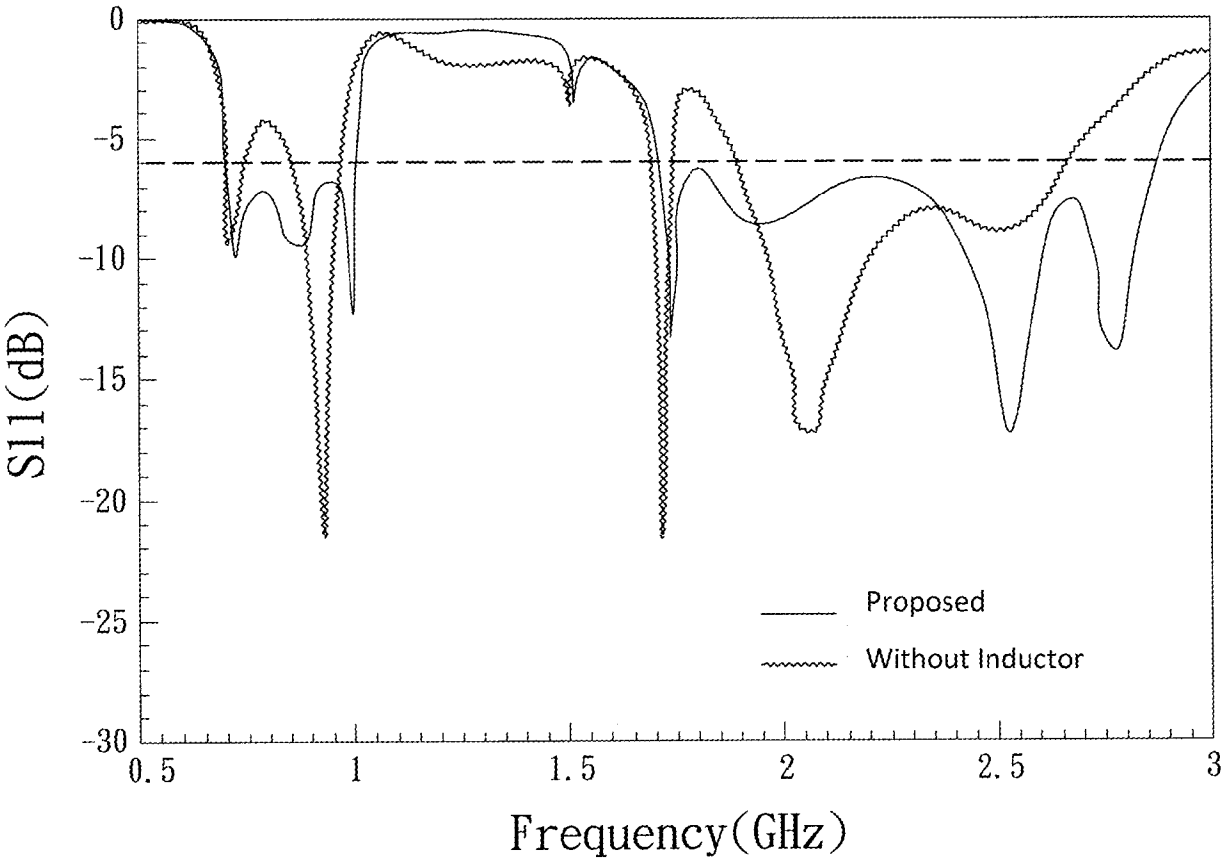
FIG. 2 shows return loss plotted against frequency for an embodiment with a chip inductor or without a chip inductor according to the present invention.
Figure 3:
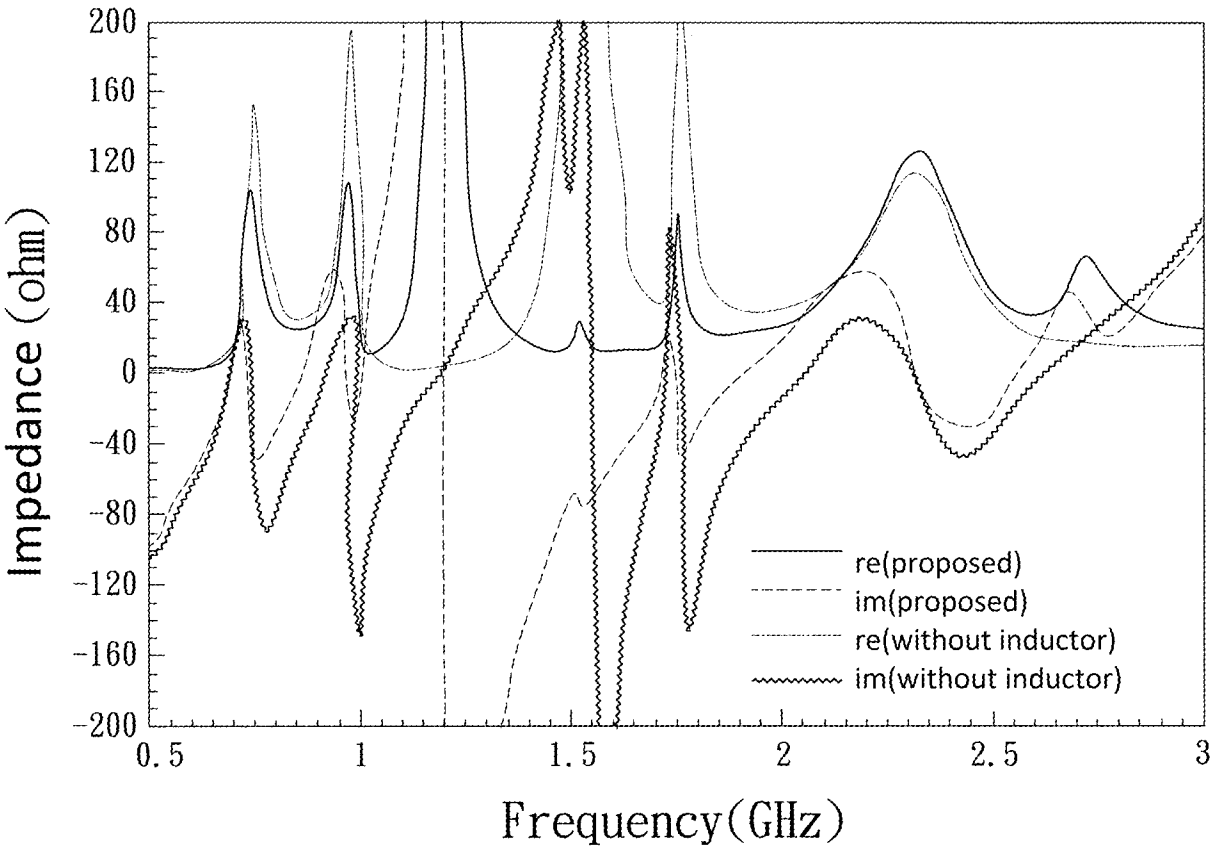
FIG. 3 is a graph of impedance versus frequency plot for an embodiment with a chip inductor or without a chip inductor according to the present invention.

Refer to FIG. 2, it shows return loss plotted against frequency for an embodiment with a chip inductor or without a chip inductor of the present invention. Without the chip inductor, an imaginary part of a mode at low frequency 0.74 GHz/0.96 GHz is much lower/larger. By means of a direct-fed monopole and the chip inductor, a current at a feed end is dispersed so that current near the feed point becomes smaller. Thus the coupling of the feed end and the coupled monopole is getting smaller and the amplitude of a real part at the low frequency 0.74 GHz/0.96 GHz is getting smaller. Also refer to FIG. 3, a graph of impedance versus frequency plot for an embodiment with a chip inductor or without a chip inductor according to the present invention is disclosed. Without the disposition of the chip inductor, the mode has quite large amplitude of the impedance at 1.54 GHz of the mode. After adding the chip inductor, the mode shifts to low frequency 1.2 GHz and the amplitude of the real part as well as the amplitude of the imaginary part is getting larger. Thus the lower imaginary part of the two modes at low frequency is pulled up by this way. Therefore a wider bandwidth is obtained by mode-matching.

Figure 4:
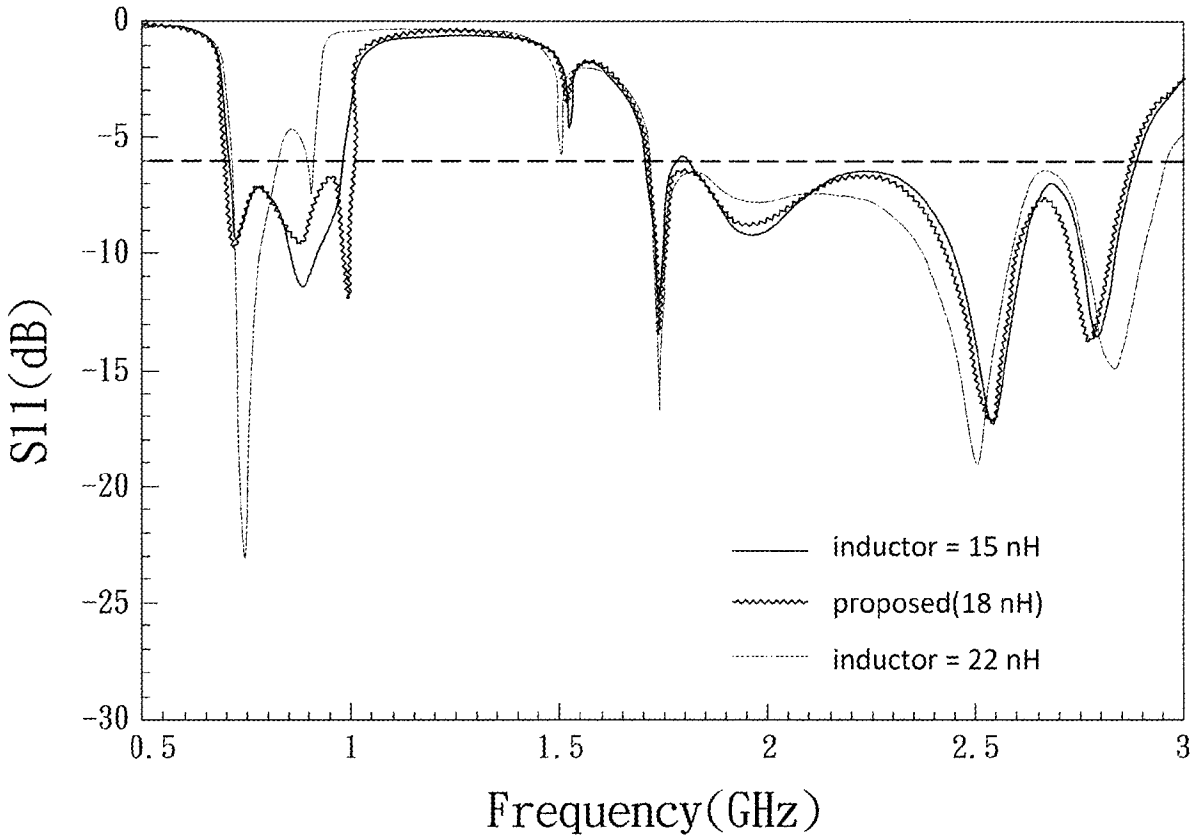
FIG. 4 is a plot of return loss versus frequency for an embodiment with a 15 nH chip inductor, with an 18 nH chip inductor, and with a 22 nH chip inductor according to the present invention.
Figure 5:
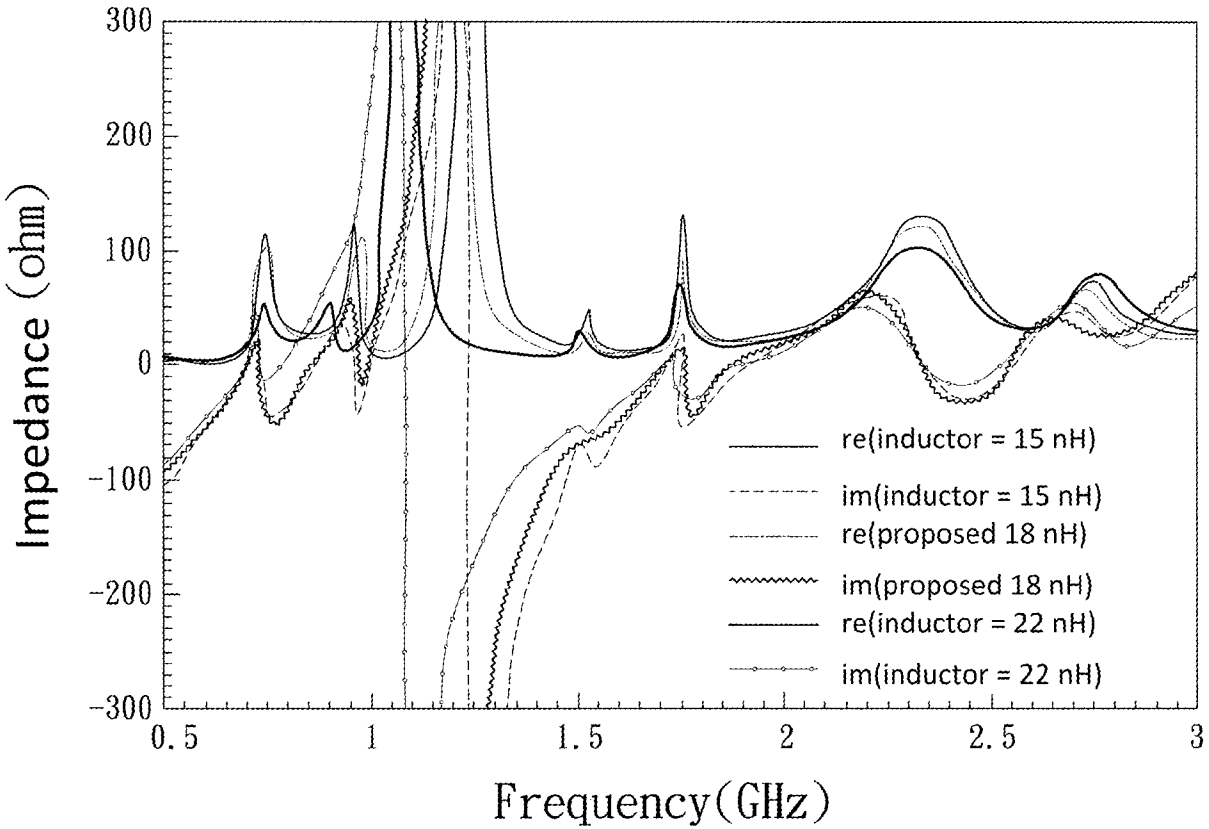
FIG. 5 is a plot of impedance versus frequency for an embodiment with a 15 nH chip inductor, with an 18 nH chip inductor, and with a 22 nH chip inductor according to the present invention.

Refer to FIG. 4 and FIG. 5, a plot of return loss versus frequency and a plot of impedance versus frequency for an embodiment with a 15 nH chip inductor, with an 18 nH chip inductor, and with a 22 nH chip inductor according to the present invention are revealed. When the chip inductor is changed into 15 nH, the amplitude of the two modes at the low frequency is significantly increased. This results in a poorer matching at the low frequency because that a shunt current from the feeding end to the monopole is reduced and the coupling of the feed end and the coupled monopole antenna element is increased when the inductance is reduced. On the other hand, when the chip inductor is changed into 22 nH, the shunt current to the monopole is increased and the coupling is reduced. This causes small impedance. Thus the 18 nH chip inductor is an optimal option.

Figure 6:
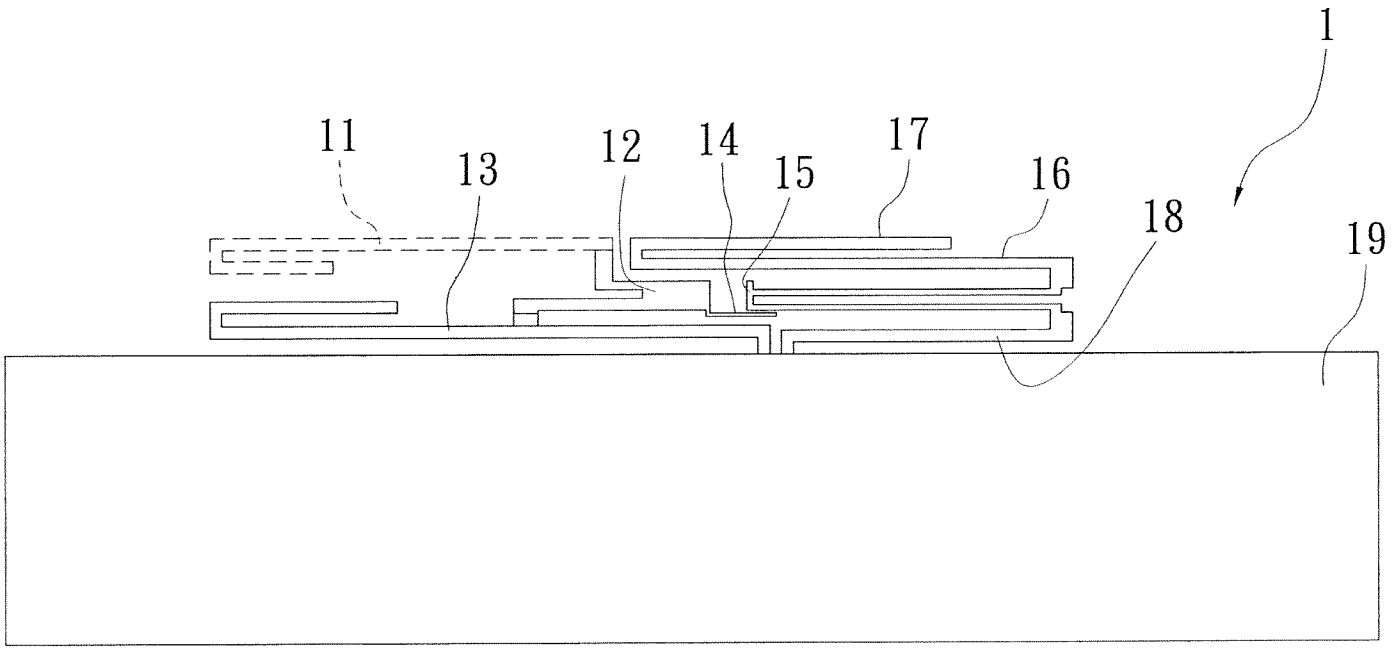
FIG. 6 is a schematic drawing showing a structure of an embodiment with a modified first path according to the present invention.
Figure 7:
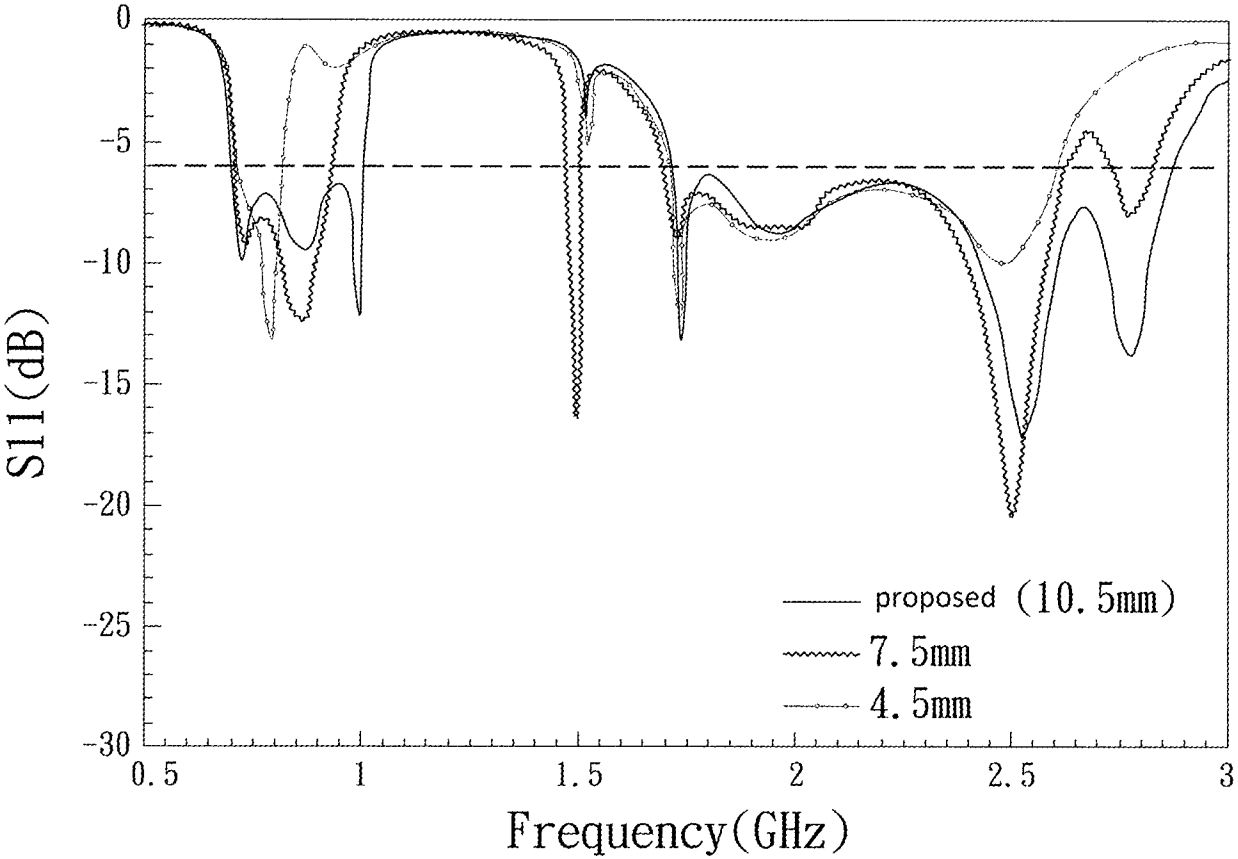
FIG. 7 is a plot of return loss versus frequency for an embodiment with a modified first path according to the present invention.
Figure 8:
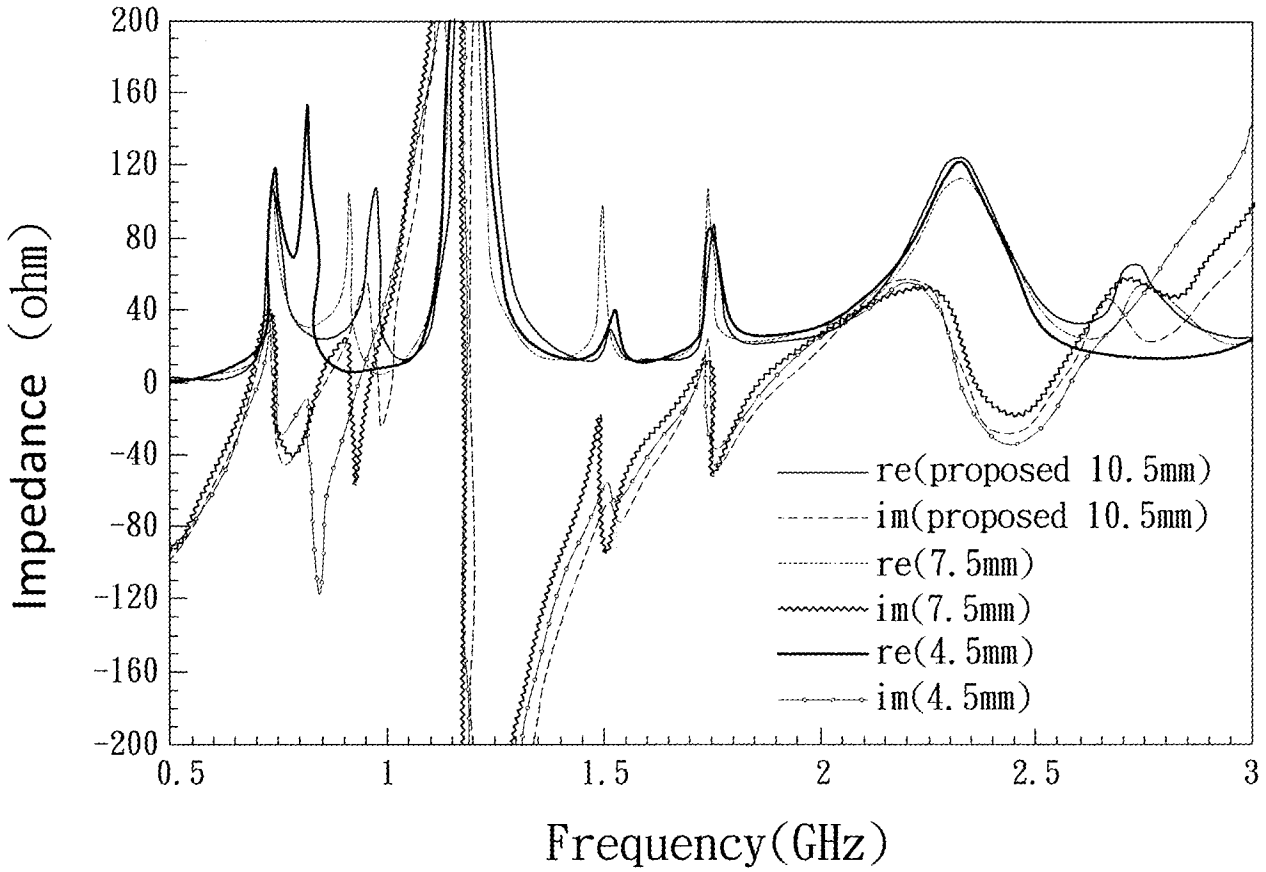
FIG. 8 is a graph of impedance versus frequency plot for an embodiment with a modified first path according to the present invention.

Refer to FIG. 6, a schematic drawing showing a structure of an embodiment with a modified first path 11 is revealed. Also refer to FIG. 7 and FIG. 8, a plot of return loss versus frequency and a plot of impedance versus frequency for the embodiment with a modified first path 11 are disclosed. The first path 11 of the antenna 1 is getting shortened. With reference of the figures, it is learned that the mode at the low frequency of 0.96 GHz is shifted toward the low frequency.

This is due to that the unipolar current density is increased when the first path 11 is shortened. And the unipolar inductance from the grounding portion 19 is increasing. Thus the second mode is moved toward the low frequency.

Figure 9:
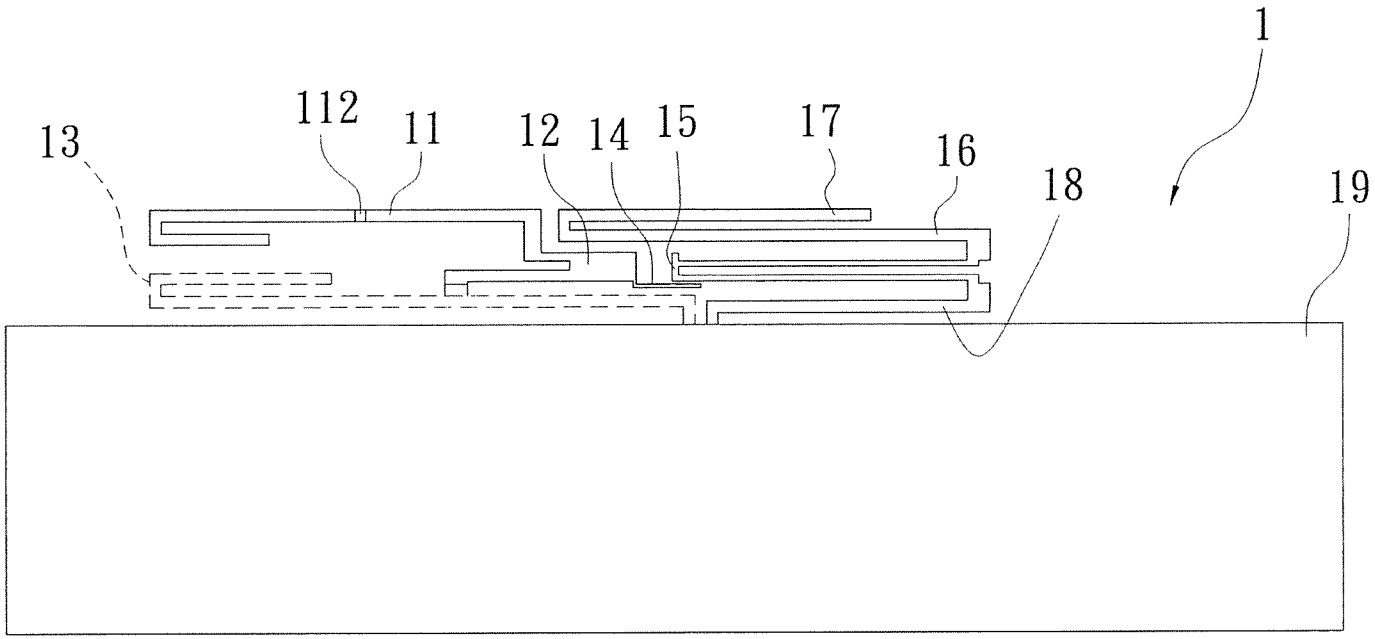
FIG. 9 is a schematic drawing showing a structure of an embodiment with a modified third path according to the present invention.
Figure 10:
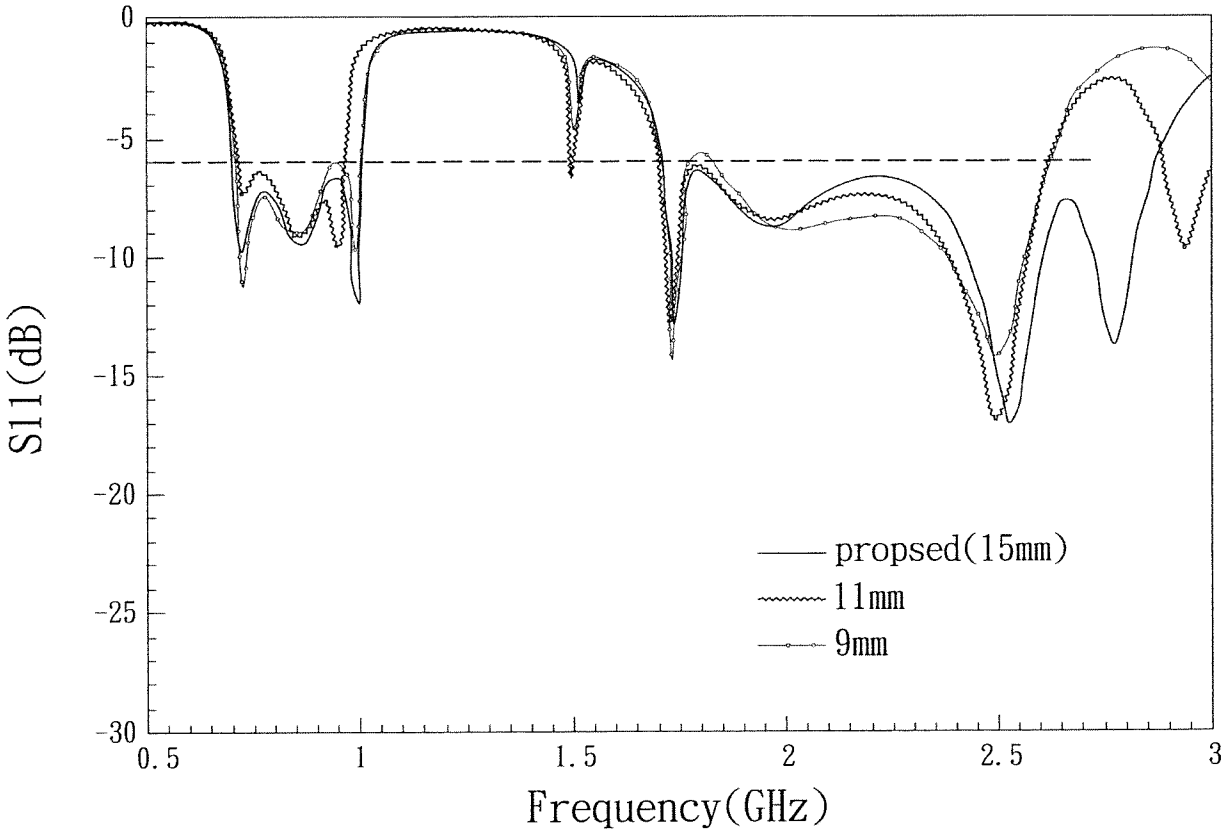
FIG. 10 is a plot of return loss versus frequency for an embodiment with a modified third path according to the present invention.
Figure 11:
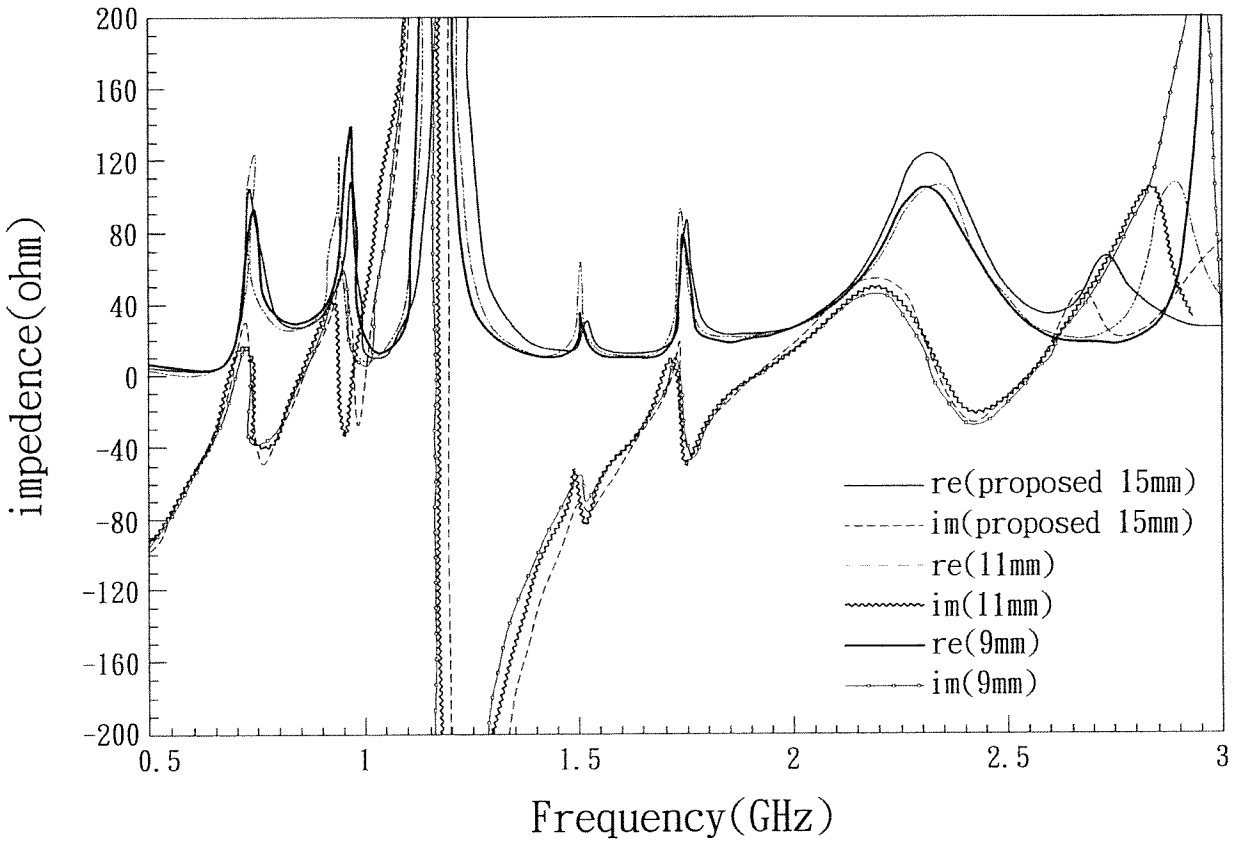
FIG. 11 is a graph of impedance versus frequency plot for an embodiment with a modified third path according to the present invention.
Figure 12:
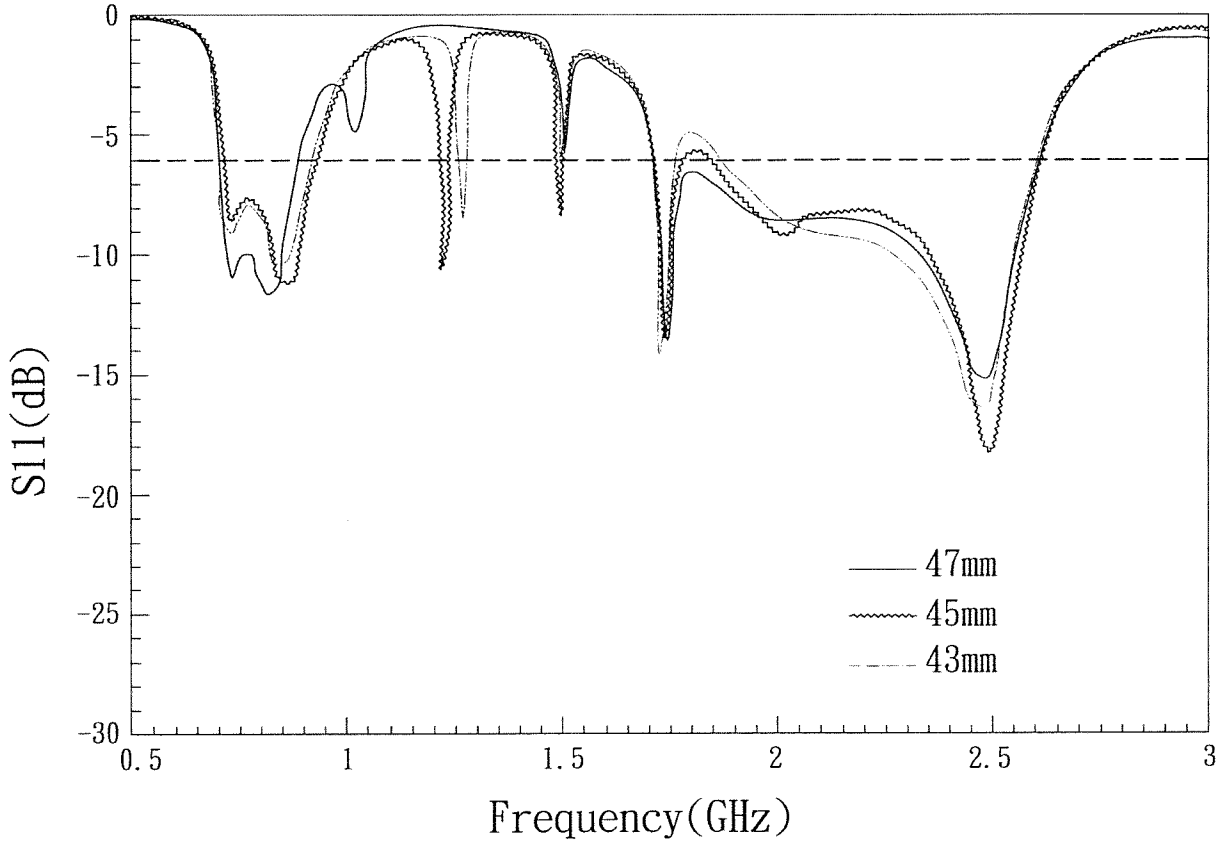
FIG. 12 is a plot of return loss versus frequency for a first bent part of a modified third path according to the present invention.
Figure 13:
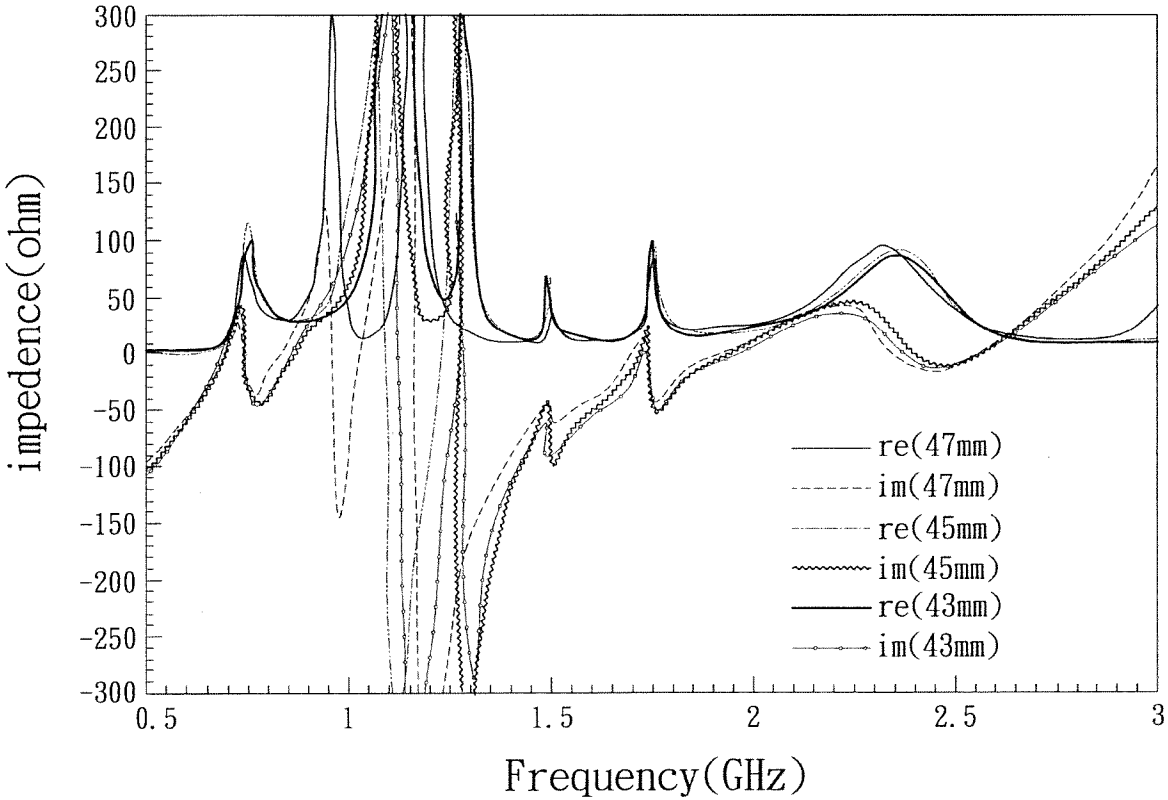
FIG. 13 is a graph of impedance versus frequency plot for a first bent part of a modified third path according to the present invention.
Figure 14:
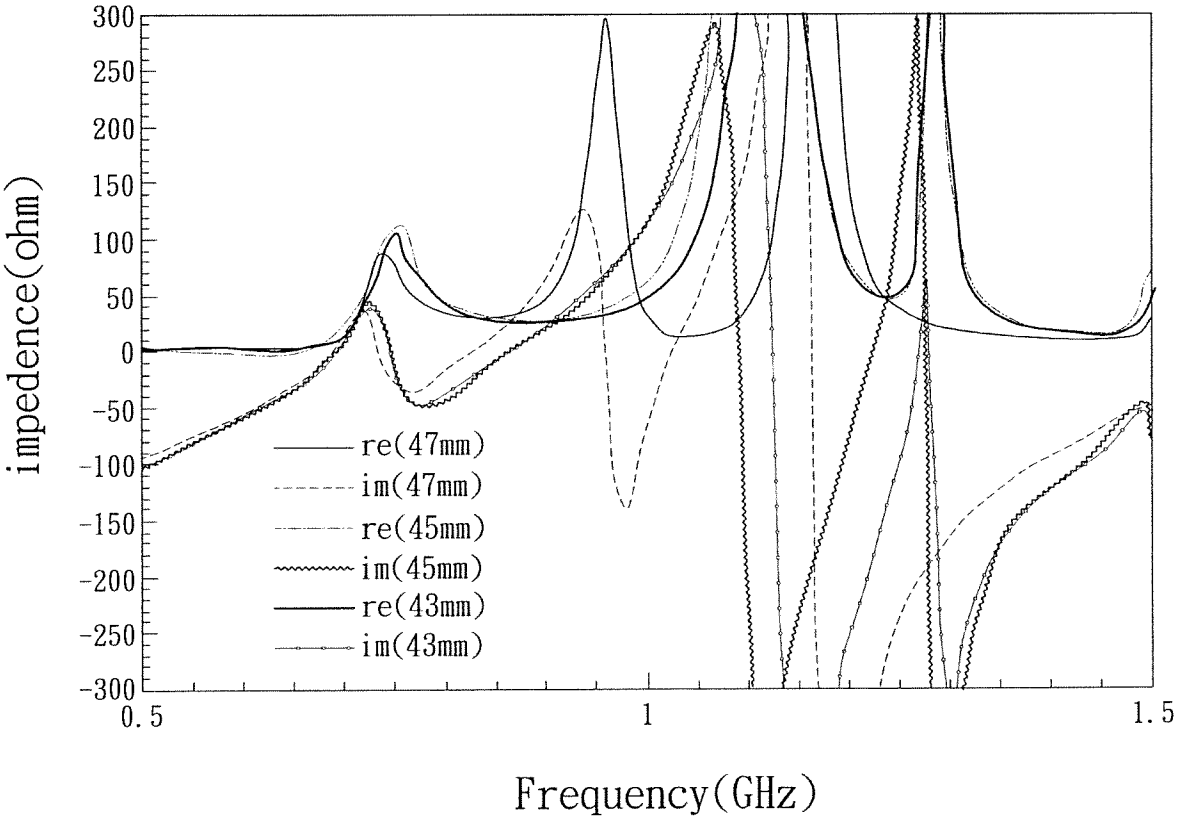
FIG. 14 is another graph of impedance versus frequency plot for a first bent part of a modified third path according to the present invention.

Refer to FIG. 9, a schematic drawing showing a structure of an embodiment with a modified third path is revealed. The third path 13 of the antenna 1 is gradually shortened. Also refer to FIG. 10 and FIG. 11, it is learned that although the third path 13 is an excitation path of 0.96 GHz mode, the changing of the length of the rear end thereof has little influence on the low frequency mode of 0.96 GHz. This is because that the current distribution of this mode at the rear end is quite small so that only matching changes. Take a look at the high frequency mode of 2. 7 GHz, it continues to shift to the high frequency. An increase of the path length at the rear end is for shifting the third harmonic frequency of the third path 13 to low frequency so that the mode can be applied to LTE-2500 band. Moreover, refer to FIG. 12, FIG. 13 and FIG. 14, a plot of return loss versus frequency and graphs of impedance versus frequency for an embodiment with a modified first bent part of a third path are revealed. After the first bent part 131 of the third path 13 being removed, the third path is still shortened from the left side to the right side. It is obvious that the mode is gradually shifted to the high frequency. And it is quite clear that this path is the excited 0.96 GHz mode.

Figure 15:
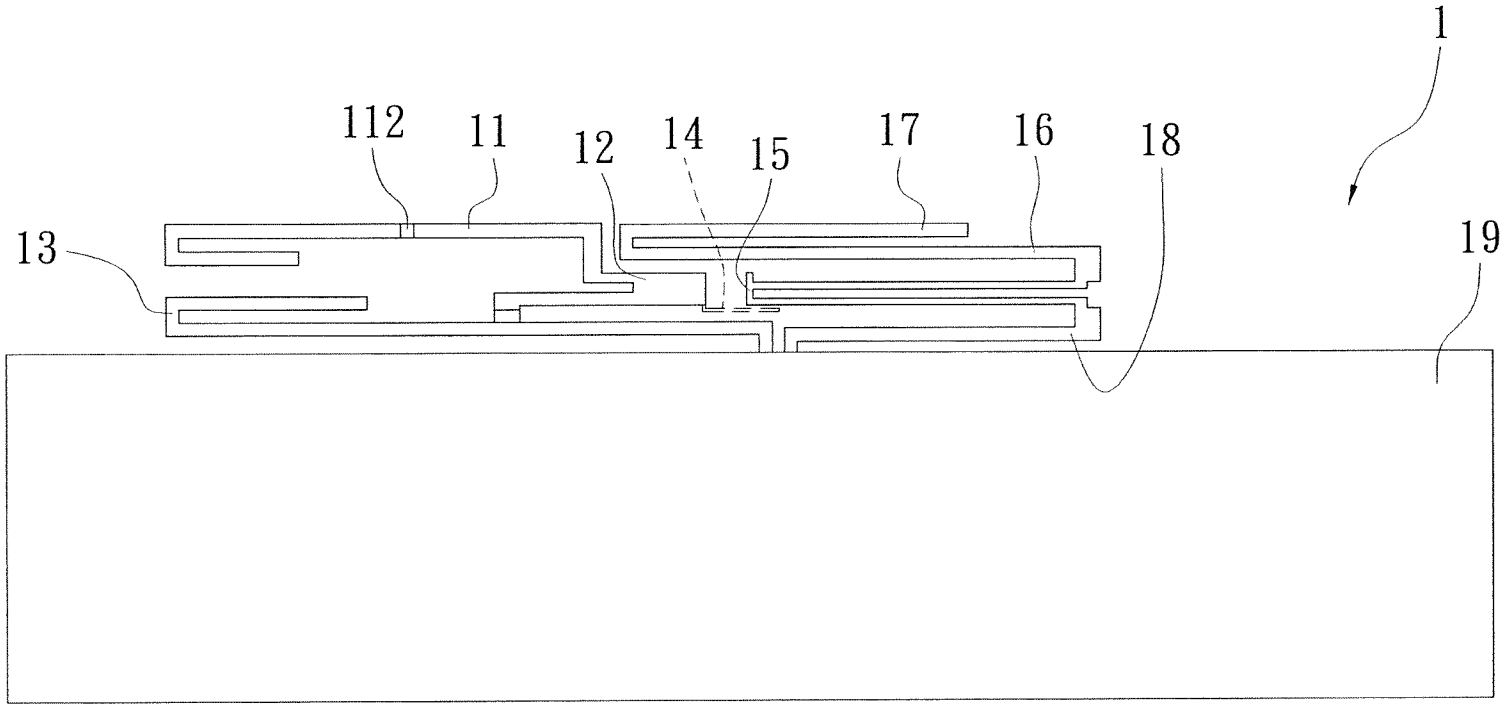
FIG. 15 is a schematic drawing showing a structure of an embodiment with a modified fourth path according to the present invention.
Figure 16:
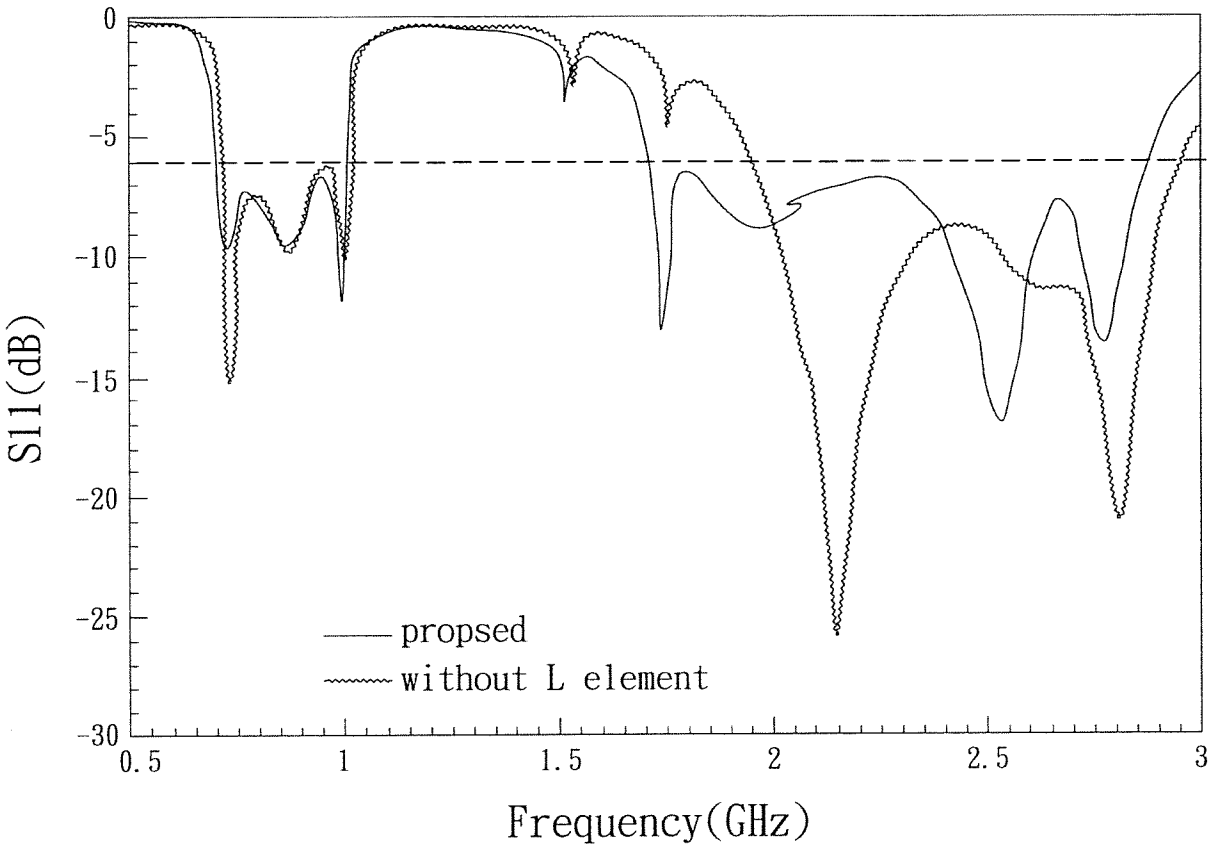
FIG. 16 is a plot of return loss versus frequency for an embodiment with a modified fourth path according to the present invention.
Figure 17:
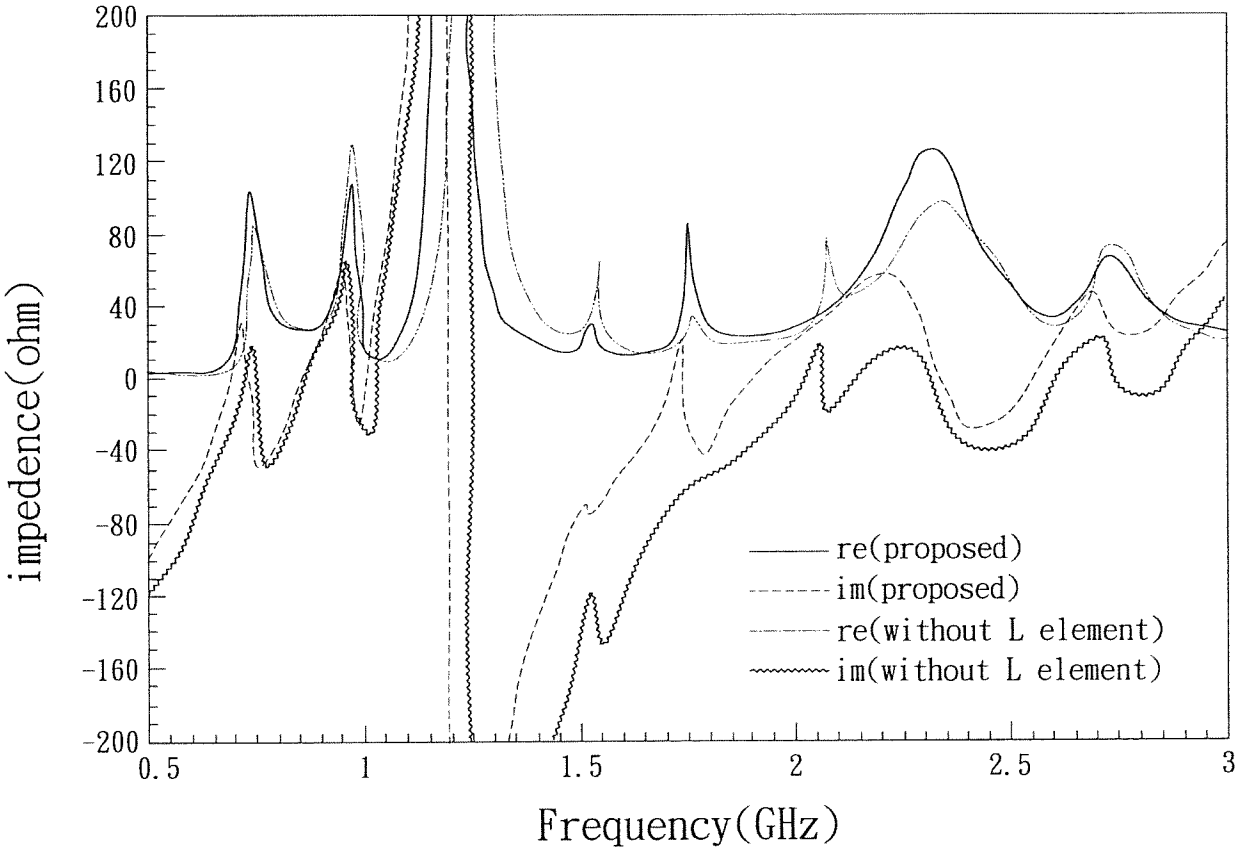
FIG. 17 is a graph of impedance versus frequency plot for an embodiment with a modified fourth path according to the present invention.

Refer to FIG. 15, a schematic drawing showing a structure of an embodiment with a modified fourth path is revealed. Refer to FIG. 16 and FIG. 17, when the fourth path 14 of the antenna 1 is removed, a real part and an imaginary part of the mode at 1.75 GHz are both lower. After addition of the fourth path 14, both the real part and the imaginary part are increased. A central point of the amplitude of the imaginary part is moved toward the zero level so that the imaginary part is getting closer to zero. Thus the total bandwidth is increased. Moreover, when the fourth path 14 is deleted, the total impedance of the mode at the high frequency and at the intermediate frequency is too low. The reduction of the total impedance is due to that the coupling of the direct-fed monopole and the coupled monopole is reduced when the fourth path 14 is deleted. A new mode value is generated at 2.06 GHz. This mode value is excited by a seven-fourths wavelength of 0.73 GHz and the current is concentrated on a path of the coupled monopole, with a presence of a pole of 40.4. Thus the fourth path 14 not only has great effect on impedance matching at high and the intermediate frequency but also inhibits the seven-fourths wavelength of 0.73 GHz.

Figure 18:
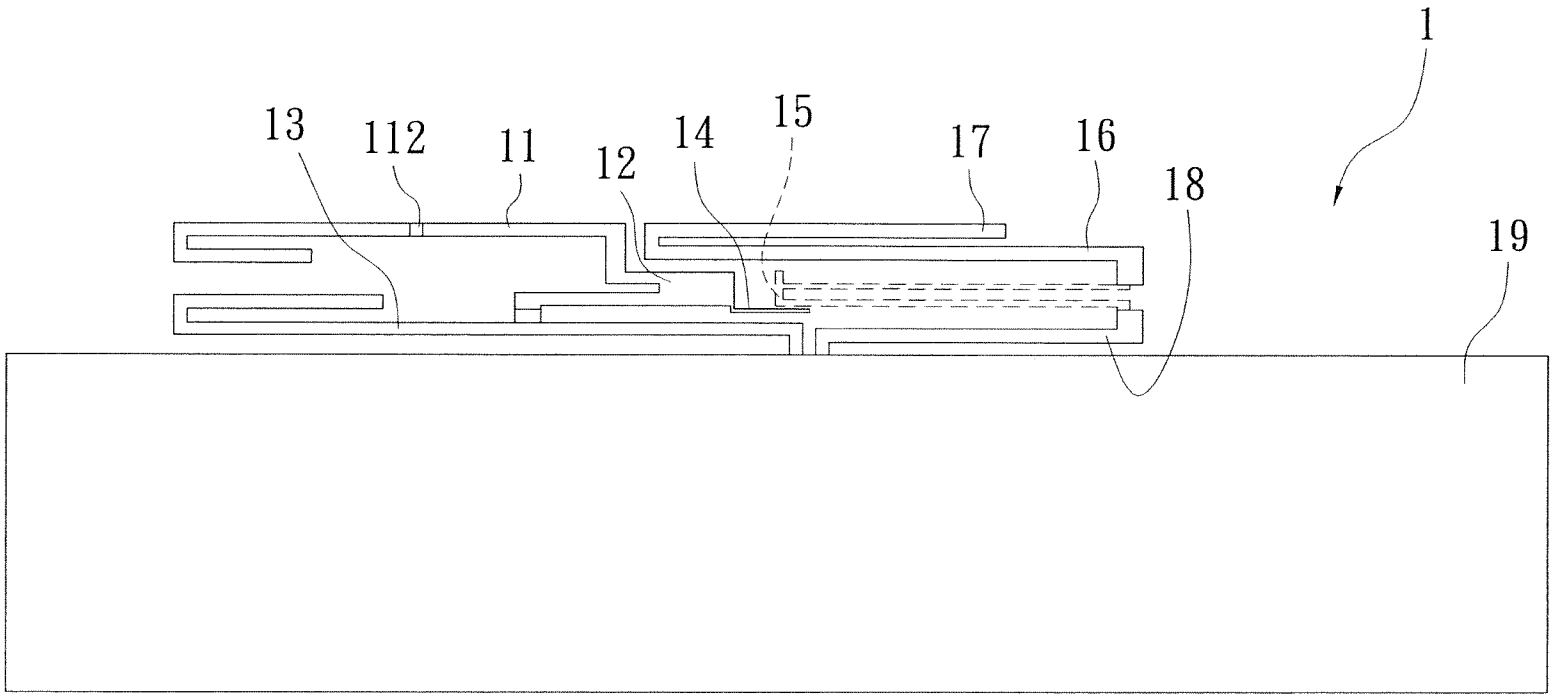
FIG. 18 is a schematic drawing showing a structure of an embodiment with a modified fifth path according to the present invention.
Figure 19:
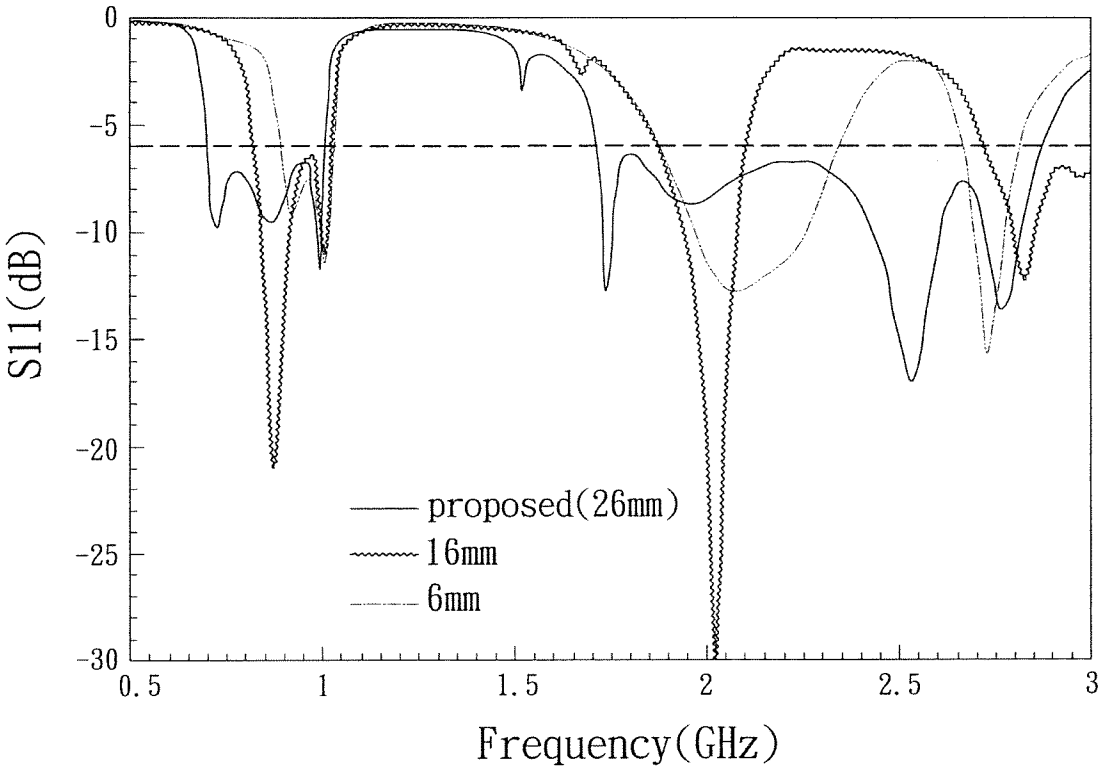
FIG. 19 is a plot of return loss versus frequency for an embodiment with a modified fifth path according to the present invention.
Figure 20:
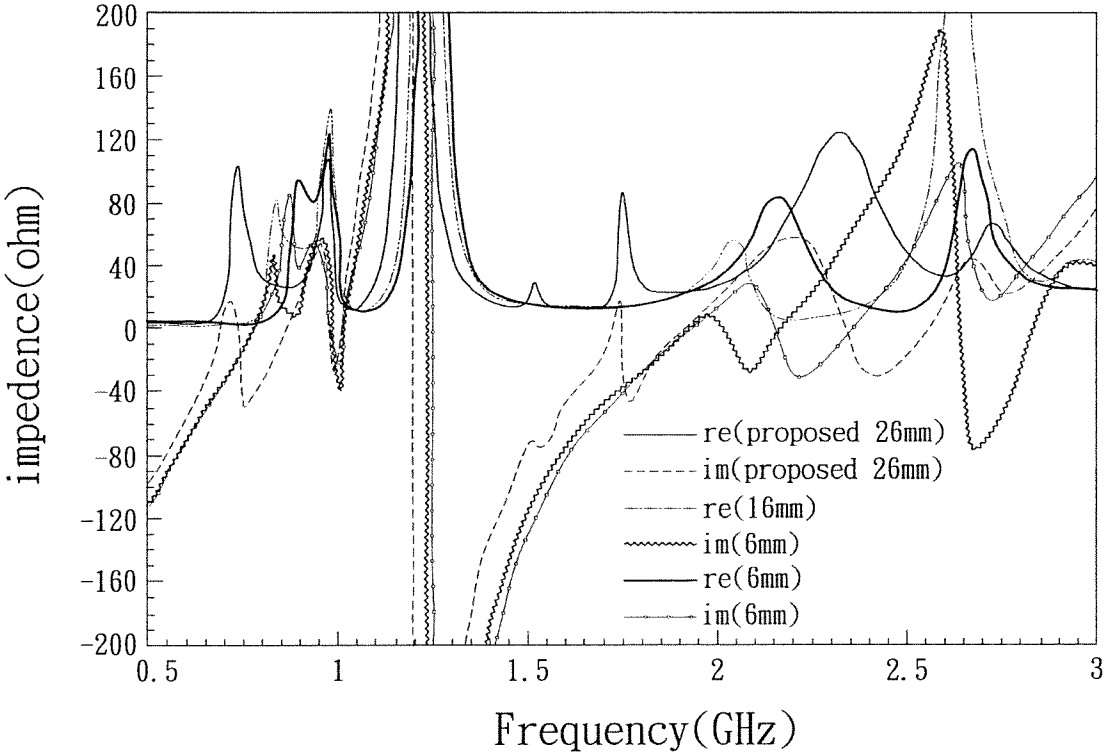
FIG. 20 is a graph of impedance versus frequency plot for an embodiment with a modified fifth path according to the present invention.

Refer to FIG. 18, a schematic drawing showing a structure of an embodiment with a modified fifth path is revealed. As shown in the figure, the fifth path 15 of the antenna 1 is used to replace the chip inductor 112. The addition of the chip inductor 112 results in decreasing gain and lower efficiency. In order to prevent this from happening, the chip inductor 112 is replaced by the inductance generated by metal wires of the antenna 1. Use thin wires and increase the length of the fifth path 15 to increase the inductance. Refer to FIG. 19 and FIG. 20, when the length of the fifth path 15 is gradually shortened, it is obvious matching and modes disappear gradually at high-frequency and intermediate-frequency while the low-frequency that part has only small variations. Therefore the fifth path 15 has only a bit low-frequency shift while matching occurs at high and intermediate frequency and higher-order-modes of this mode shift toward low frequency.

Figure 21:
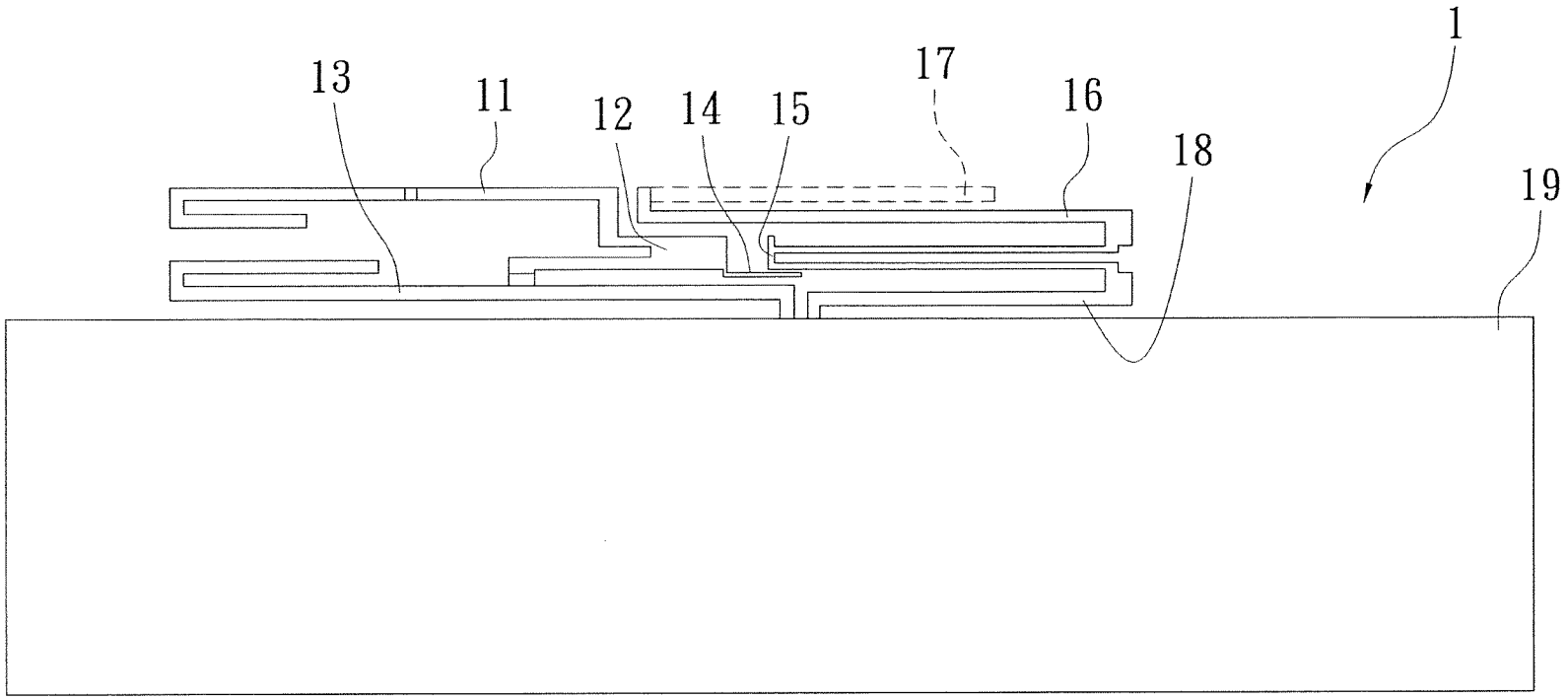
FIG. 21 is a schematic drawing showing a structure of an embodiment with a modified seventh path according to the present invention.
Figure 22:
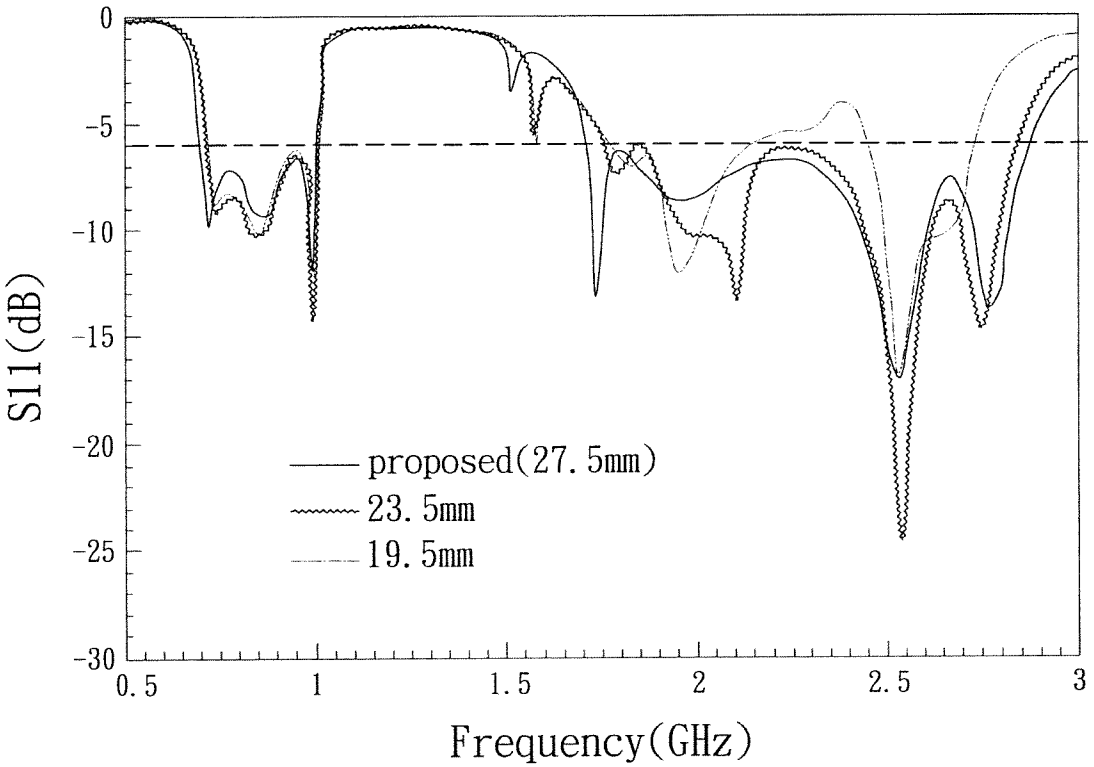
FIG. 22 is a plot of return loss versus frequency for an embodiment with a modified seventh path according to the present invention.
Figure 23:
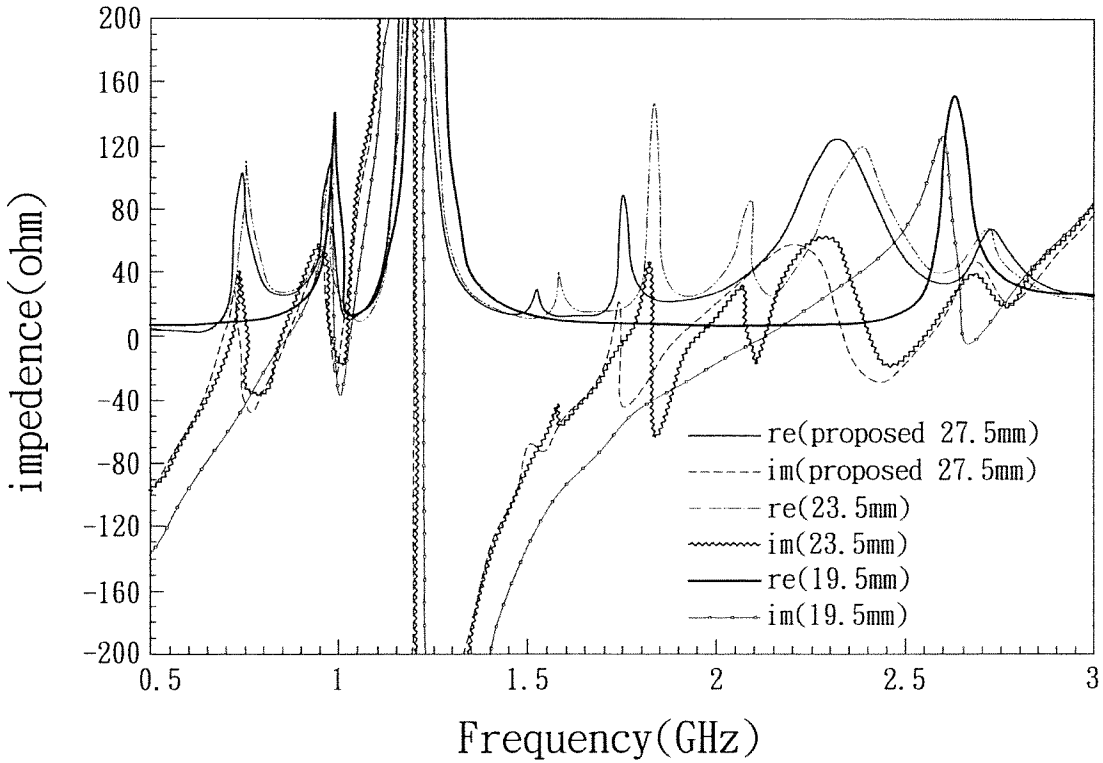
FIG. 23 is a graph of impedance versus frequency plot for an embodiment with a modified seventh path according to the present invention.

Refer to FIG. 21, a schematic drawing showing a structure of an embodiment with a modified seventh path is revealed. When the length of the rear end of the seventh path 17 is changed, there is only minimal or no apparent effect on the low frequency, as shown in FIG. 22 and FIG. 23. It is learned that the current at the rear end of the coupled monopole on the right side is quite small. Thus the rear end only has impedance matching at the low frequency while there is an obvious trend toward high frequency of high-and-intermediate frequency higher-order-modes. It is proved that this mode is a higher-order-mode of 0.74 GHz.

Figure 24:
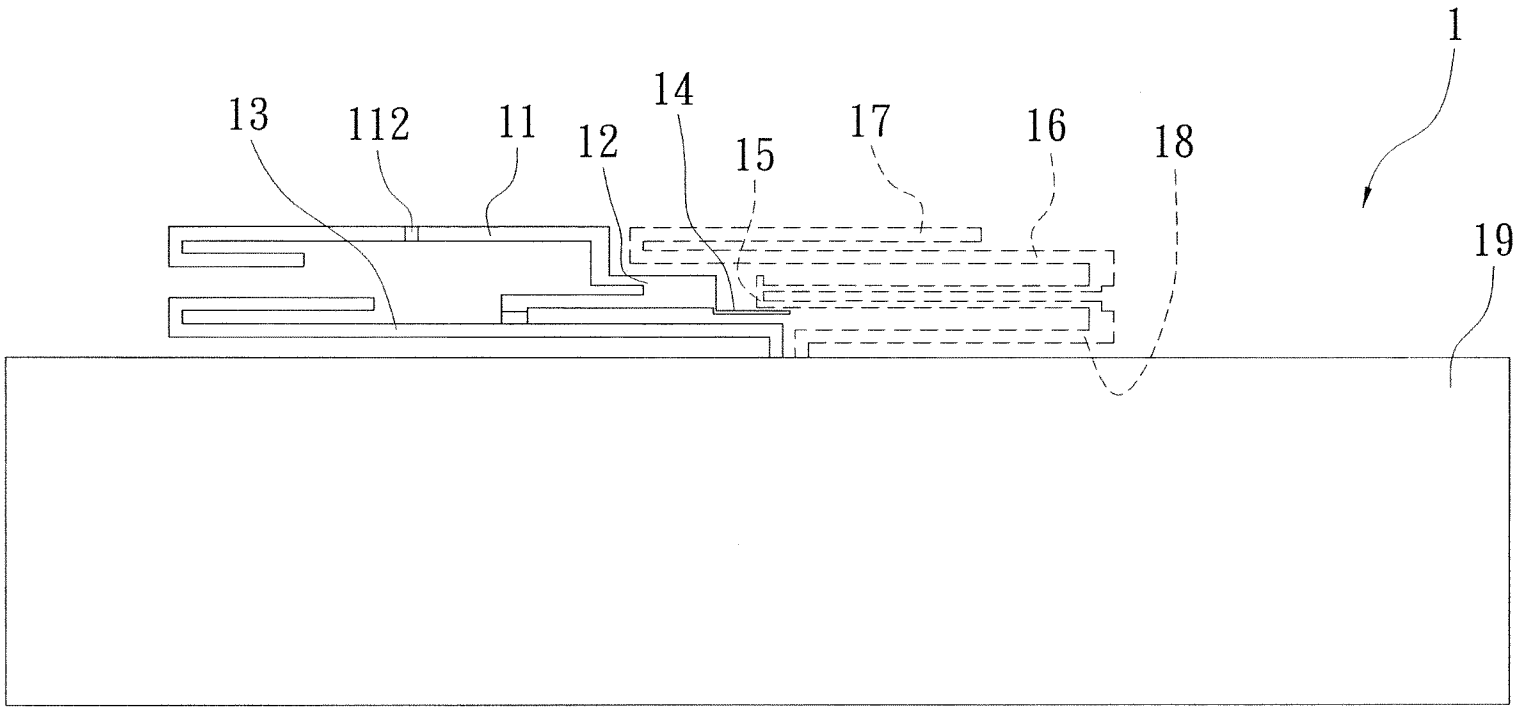
FIG. 24 is a schematic drawing showing a structure of an embodiment with a modified fifth path, a modified sixth path, a modified seventh path and a modified eighth path according to the present invention.
Figure 25:
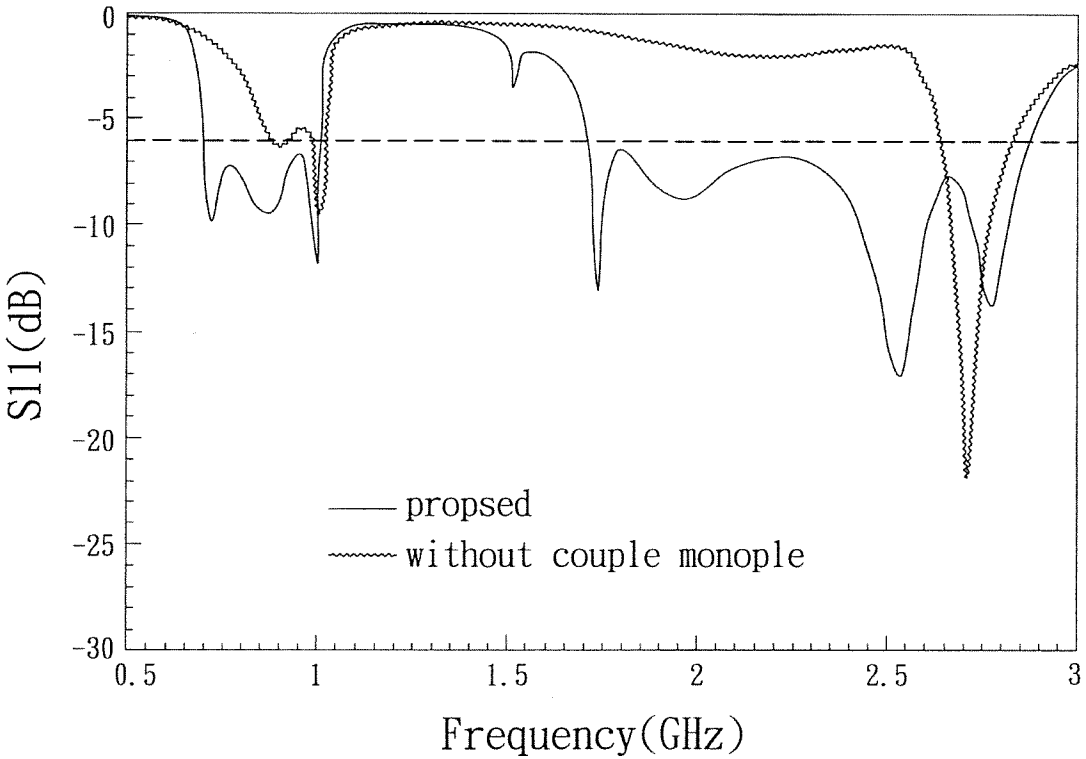
FIG. 25 is a plot of return loss versus frequency for an embodiment with a modified fifth path, a modified sixth path, a modified seventh path and a modified eighth path according to the present invention.
Figure 26:
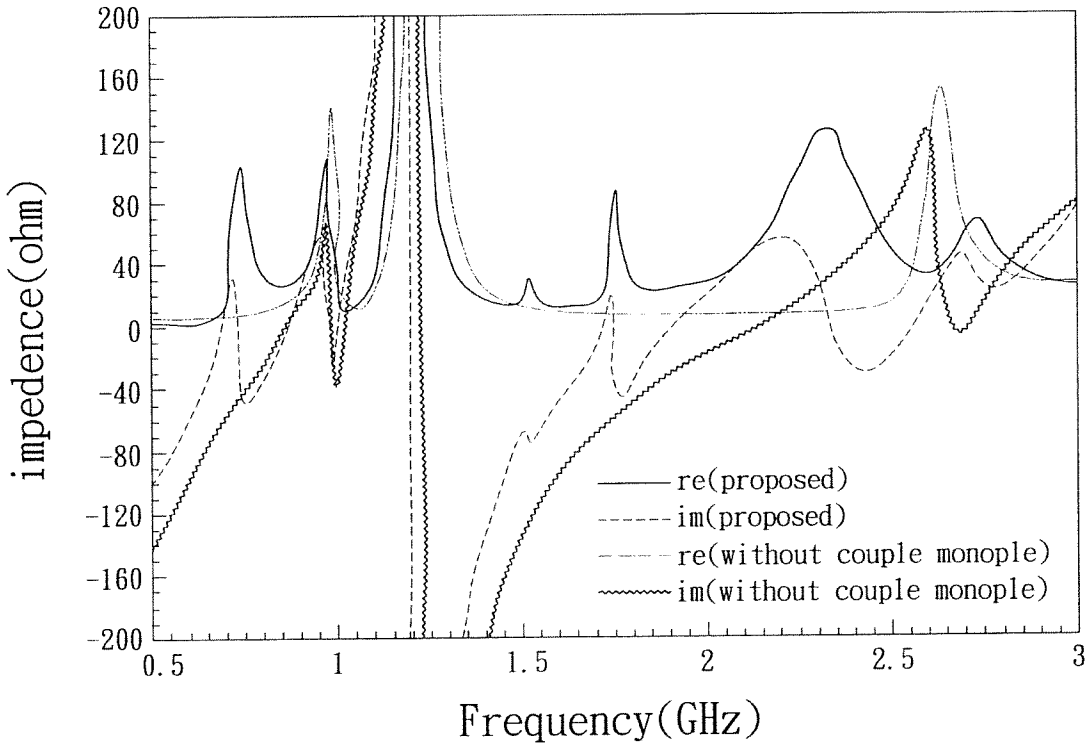
FIG. 26 is a graph of impedance versus frequency plot for an embodiment with a modified fifth path, a modified sixth path, a modified seventh path and a modified eighth path according to the present invention.

Refer to FIG. 24, a schematic drawing showing a structure of an embodiment with a modified fifth path, a modified sixth path, a modified seventh path, and a modified eighth path is disclosed. In order to understand the modes excited by the fifth path 15, the sixth path 16, the seventh path 17, and the eighth path 18 more clearly, the fifth path 15, the sixth path 16, the seventh path 17, and the eighth path 18 are all removed. Refer to FIG. 25 and FIG. 26, it is learned that the mode with lowest frequency of 0.74 GHz, 1.51 GHz, 1.75 GHz, and 2.35 GHz all disappear. Thus the lowest frequency of the fifth path 15, the sixth path 16, the seventh path 17, and the eighth path 18 is a quarter wavelength at the base frequency while the rest are higher-order-modes of the mode.

In summary, compared with the structure available now, the present invention can cover the LTE700/2300/2700 and GSM850/900/1800/1900/UMTS operations and has higher practical value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A planar multi-band antenna for tablet computers comprising:

a direct-fed plurality of interconnected conductive monopole paths including:

a first path receiving a feed signal, the first path having a bent part formed at a first end thereof and a chip inductor disposed at a middle portion of the first path;

a second path whose two ends are extended to form a bent part and an extension part respectively while the bent part is connected to a second end of the first path;

a third path in which a first bent part is formed at a first end thereof and a second bent part is formed at a second end thereof while a middle part thereof is connected to the extension part of the second path;

a fourth path having a first end thereof connected to the second path; and, a coupled monopole portion being coupled to the direct-fed plurality of interconnected monopole paths, the coupled monopole portion having a plurality of interconnected conductive monopole paths including:

a fifth path that is coupled to a second end of the fourth path and having two substantially symmetric ends thereof extended to form a first extension part and a second extension part respectively while the first extension part and the second extension part are corresponding and parallel to each other;

a sixth path having a first bent part and a second bent part on two ends thereof respectively while the first bent part of the sixth path is connected to the first extension part of the fifth path;

a seventh path that is connected to the second bent part of the sixth path;

an eighth path that includes a first bent part and a second bent part formed on two ends thereof respectively; the first bent part of the eighth path is connected to the second extension part of the fifth path; and a grounding portion connected to the second bent part of the third path and the second bent part of the eighth path.

* * * * *